US006605788B2

(12) United States Patent
Demissy et al.

(10) Patent No.: US 6,605,788 B2
(45) Date of Patent: Aug. 12, 2003

(54) AIR-INSULATED HIGH-VOLTAGE DISCONNECTOR

(75) Inventors: Daniel Demissy, St. Bernard de Lacolle (CA); Anh-Dung Huynh, Montréal (CA); Richard Marchand, Beauharmois (CA)

(73) Assignee: Alstom, Paris (FR)

( * ) Notice: Subject to any disclaimer, the term of this patent is extended or adjusted under 35 U.S.C. 154(b) by 43 days.

(21) Appl. No.: 09/994,680

(22) Filed: Nov. 28, 2001

(65) Prior Publication Data

US 2002/0092741 A1 Jul. 18, 2002

(30) Foreign Application Priority Data

Jan. 12, 2001 (FR) ..... 01 00424

(51) Int. Cl.[7] ..... H01H 21/54
(52) U.S. Cl. ..... 200/17 R; 200/400; 218/7
(58) Field of Search ..... 200/17 R, 400, 200/401, 500, 501; 218/1, 7, 14, 84, 92, 120, 140, 153, 154

(56) References Cited

U.S. PATENT DOCUMENTS 3,388,225 A 6/1968 Foti
3,544,741 A 12/1970 Kuhn
3,544,742 A 12/1970 Frink
4,622,443 A * 11/1986 Mooz ..... 200/50 R
5,013,876 A * 5/1991 Chabala ..... 200/254
5,739,489 A * 4/1998 Marmonier et al. ..... 200/17 R
5,859,398 A * 1/1999 McKean ..... 218/7
6,066,820 A * 5/2000 Niklaus ..... 200/501

FOREIGN PATENT DOCUMENTS

FR 2 674 985 A 10/1992

* cited by examiner

*Primary Examiner*—Elvin Enad
*Assistant Examiner*—K. Lee
(74) *Attorney, Agent, or Firm*—Sughrue Mion, PLLC

(57) ABSTRACT

An air-insulated high-voltage disconnector including a pivotally-mounted arm suitable for pivoting at one of its ends about a horizontal axis that is perpendicular to the axis Δ of the arm, and also suitable for turning about its own axis Δ, the free end of the arm carrying a contact part or "hammer" which, when the disconnector is in the closed position, co-operates with a jaw comprising a jaw support to which two facing rows of contact fingers are fixed, wherein the hammer is equipped with contact tabs co-operating with the contact fingers, each contact tab forming a wedge of angle β, which wedge acts, during disconnector closure, to meet the corresponding row of fingers with an angle of attack α, said angle of attack α being less than 90°.

9 Claims, 7 Drawing Sheets

1
2
3
4B
5B
6
7
8
9
10
11
E
F
H
H

AIR-INSULATED HIGH-VOLTAGE DISCONNECTOR

The present invention relates to an air-insulated high-voltage disconnector.

BACKGROUND OF THE INVENTION

A disconnector includes, in particular, a pivotally-mounted arm, sometimes referred to as a "knife", mounted to pivot about a horizontal axis and electrically connected at one of its ends to a first connector disposed at the top of a first insulating column. The other end of the arm, i.e. the free end, is provided with a contact part or "hammer" which, when the disconnector is in the closed position, co-operates with a jaw connected to a second connector disposed at the top of a second insulating column.

During disconnector closure, once the pivotally-mounted arm has been lowered, it is then turned about its axis through 90°, thereby bringing the hammer into contact with the contact parts of the jaw.

The jaw is made up of two facing parallel rows of contact parts, each part being formed of a curved copper blade fixed to a jaw support. The hammer, which extends the arm at its end, is a part made of bronze that is heavy and costly and whose section in a plane perpendicular to the axis of the arm corresponds to a circle of diameter smaller than the diameter of the arm and that is flattened along one diameter so that it is extended to coincide with the diameter of the arm, the thickness of the two diametrically opposite extensions being in the range 2 mm to 3 mm, with rounded edges.

French Patent 2 674 985 describes such a disconnector.

OBJECTS AND SUMMARY OF THE INVENTION

The present invention proposes to improve certain features of a disconnector of that type, and it provides an air-insulated high-voltage disconnector including a pivotally-mounted arm suitable for pivoting at one of its ends about a horizontal axis that is perpendicular to the axis $\Delta$ of the arm, and also suitable for turning about its own axis $\Delta$, the free end of the arm carrying a contact part or "hammer" which, when the disconnector is in the closed position, co-operates with a jaw comprising a jaw support to which two facing rows of contact fingers are fixed, wherein the hammer is equipped with contact tabs co-operating with the contact fingers, each contact tab forming a wedge of angle $\beta$, which wedge acts, during disconnector closure, to meet the corresponding row of fingers with an angle of attack $\alpha$, said angle of attack $\alpha$ being less than 90°.

Advantageously, the angle $\beta$ is approximately in the range 30° to 40°, and the angle $\alpha$ is about 60°.

According to another characteristic, each contact tab is provided with a curved contact face extending over an angle $\delta$, seen from the axis $\Delta$ of the arm, this angle $\delta$ being about 17°.

According to another characteristic, when the wedge of a contact tab comes into contact with one of said contact fingers, the angle $\gamma$, seen from the axis $\Delta$ of the arm, between the point of contact and the plane perpendicular to the contact finger containing the axis $\Delta$, is about 10°.

According to another characteristic, said contact fingers are fixed to the jaw support so that, when the disconnector is in the closed position, the angle E between the axis $\Delta$ of the arm and the contact fingers is greater than 90°.

According to another characteristic, said facing fingers form an angle $\phi$ between them that lies in the range 2° to 6°.

According to another characteristic, said contact fingers are tubular and open at both of their ends.

According to another characteristic, a locking abutment is fixed to a contact finger at a level situated above said hammer when the disconnector is in the closed position.

BRIEF DESCRIPTION OF THE DRAWINGS

An embodiment of the invention is described below with reference to the accompanying drawings, in which.

MORE DETAILED DESCRIPTION

Figure 1:
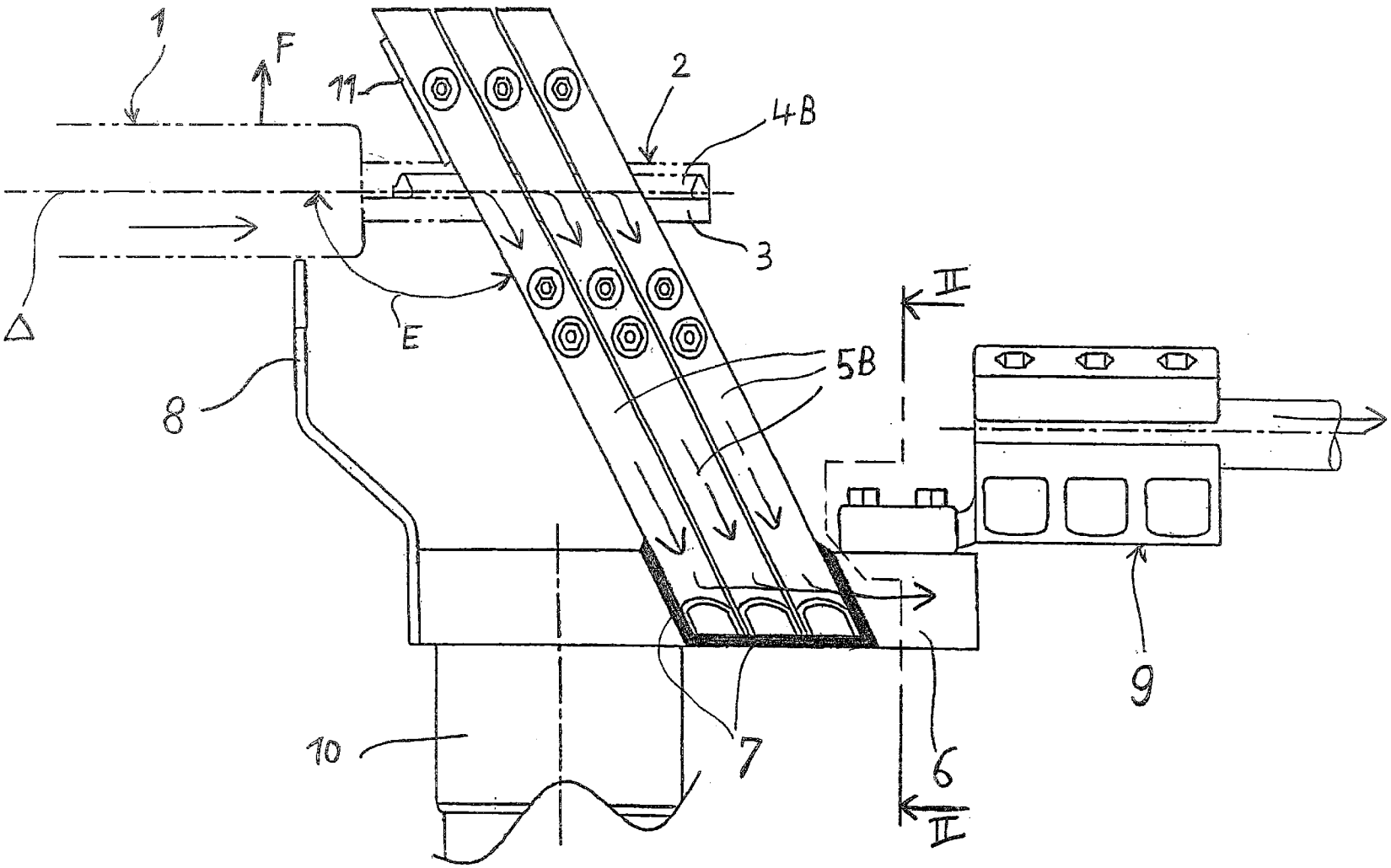
FIG. 1 is a fragmentary view from the left of FIG. 2, showing a disconnector of the invention.

FIGS. 1 to 6 are fragmentary views of a disconnector having a pivotally-mounted arm 1 of axis $\Delta$ suitable for pivoting in a vertical plane about a horizontal axis perpendicular to $\Delta$ (not shown) situated on the left of FIG. 1. The portion of the arm that is not shown, the control means for causing it to pivot about said horizontal axis, the control means for causing it to turn about its axis $\Delta$, and its support are not part of the present invention, and they may, for example, be as described in French Patent 2 674 985 with reference to its FIG. 1.

Figure 2:
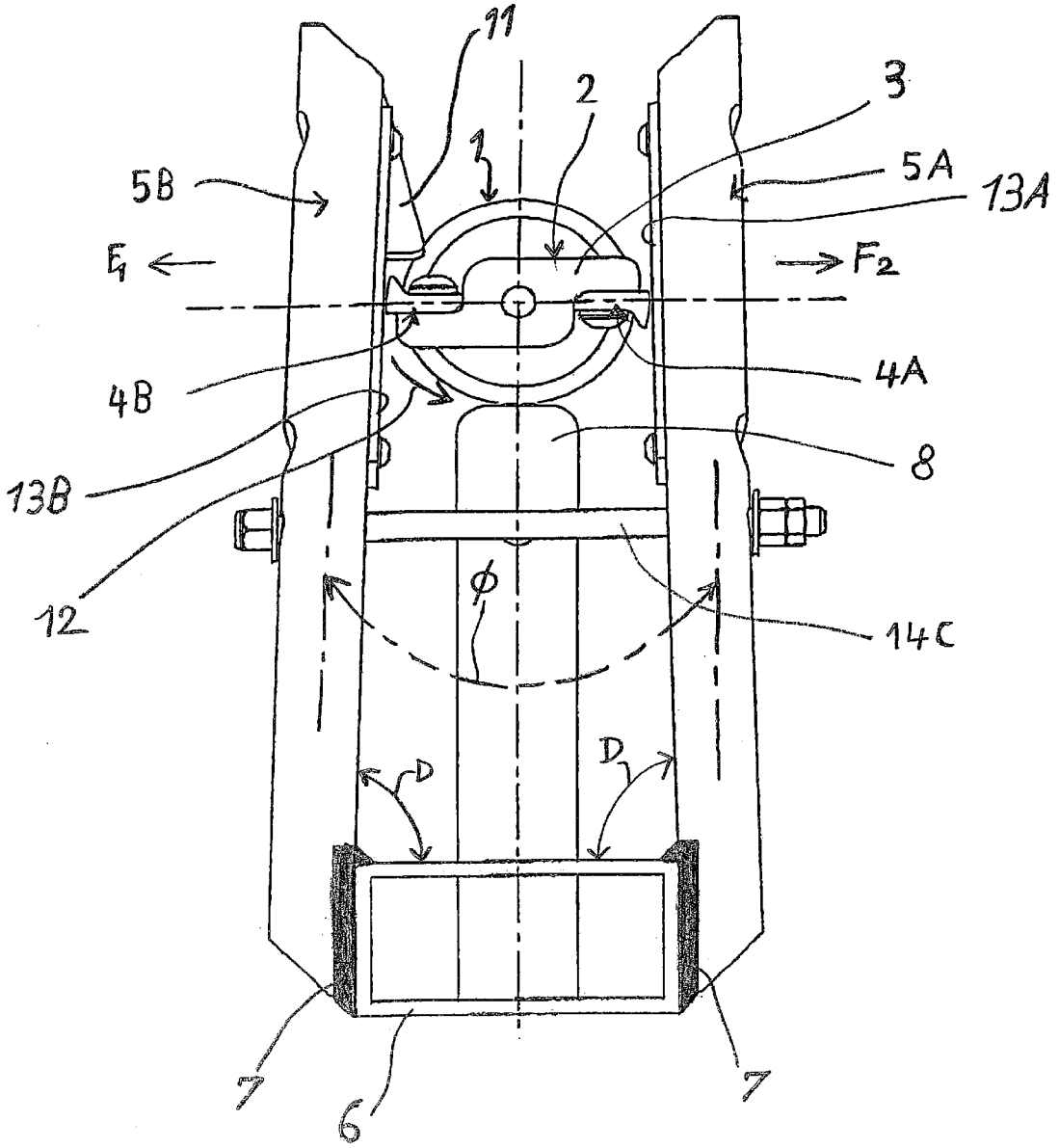
FIG. 2 is a section view on II—II of FIG. 1.

The arm 1 is tubular, as shown clearly in FIG. 2, and, at its free end, it carries a contact part referred to as a "hammer" 2.

The hammer is made up of a support part 3 which is made of aluminum and to which two copper contact tabs 4A and 4B are fixed. This makes it possible to lighten the weight of the hammer.

The contact tabs 4A and 4B are of a particular shape (described in more detail below), and they constitute contact parts which act, when the disconnector is in the closed position, to co-operate with two facing rows of contact fingers 5A and 5B of the jaw of the disconnector.

These fingers 5A and 5B are fixed to a jaw support 6 by welding 7. The jaw support 6 is fixed to an abutment 8 for limiting the extent to which the arm 1 penetrates between the fingers 5A and 5B of the jaw. A connector 9 is also fixed to the jaw support 6. A second connector (not shown) is electrically connected to that end of the arm 1 which is not shown, i.e. its end that is hinged about a horizontal axis.

The jaw is supported its top end by a support insulator of which only the mounting 10 of its top end is visible in FIG. 1.

Figure 3:
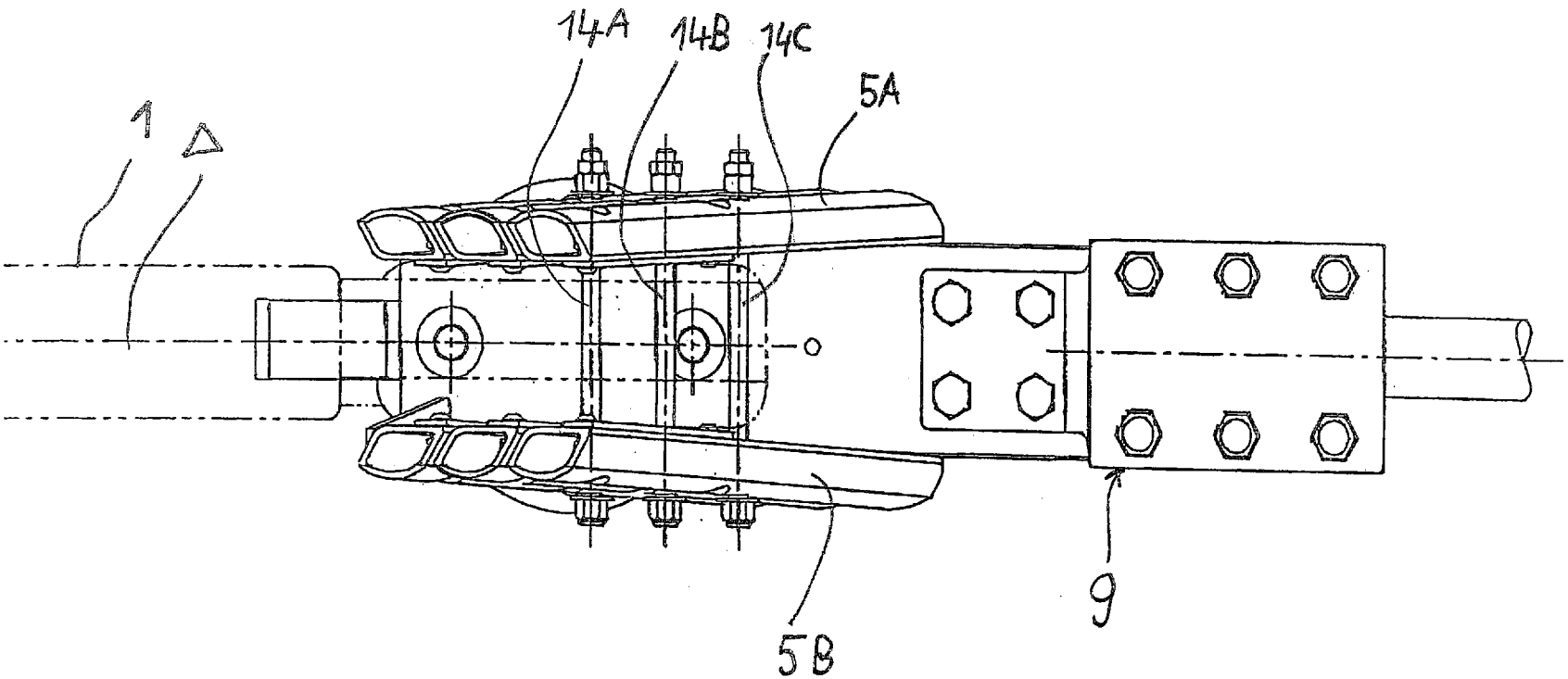
FIG. 3 is a plan view of FIG. 1.
Figure 4:
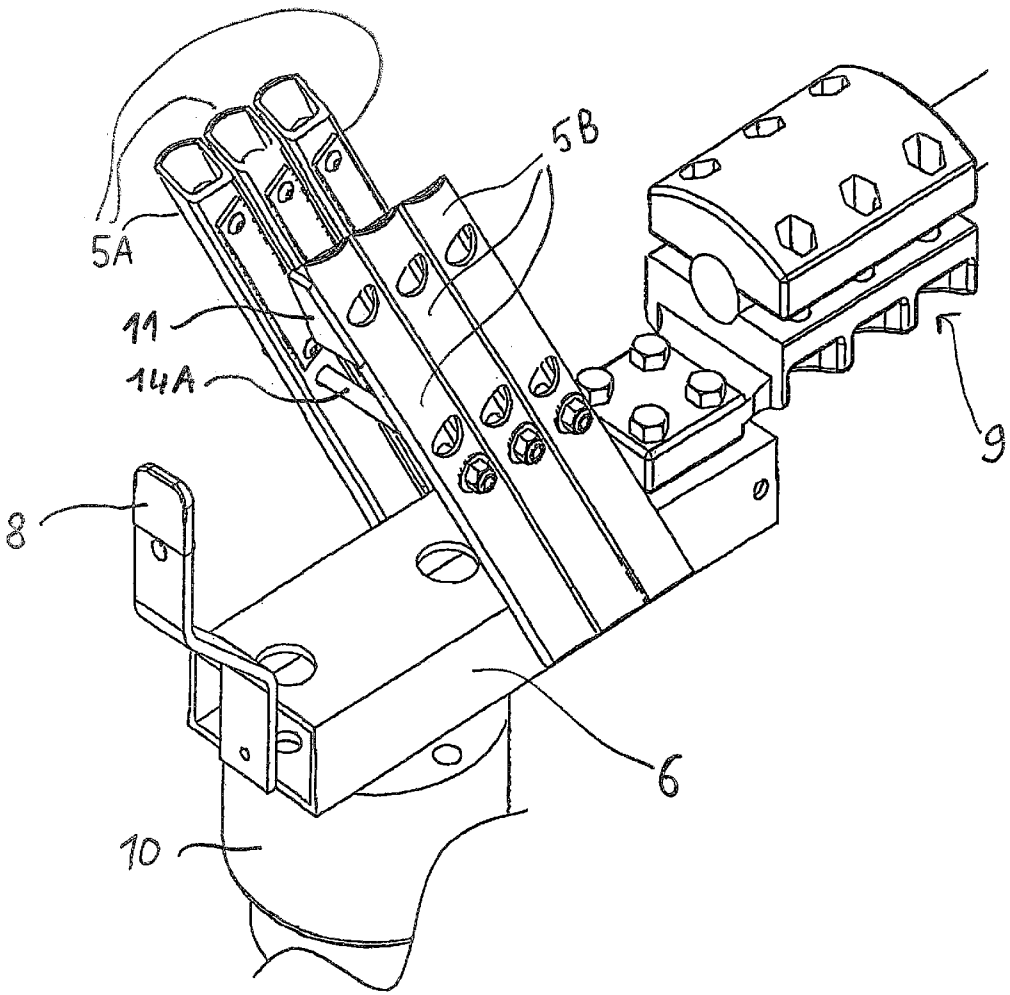
FIG. 4 is a perspective view showing the jaw of the disconnector.

FIGS. 1, 2, and 3 show the disconnector in the closed position.

Figure 7:
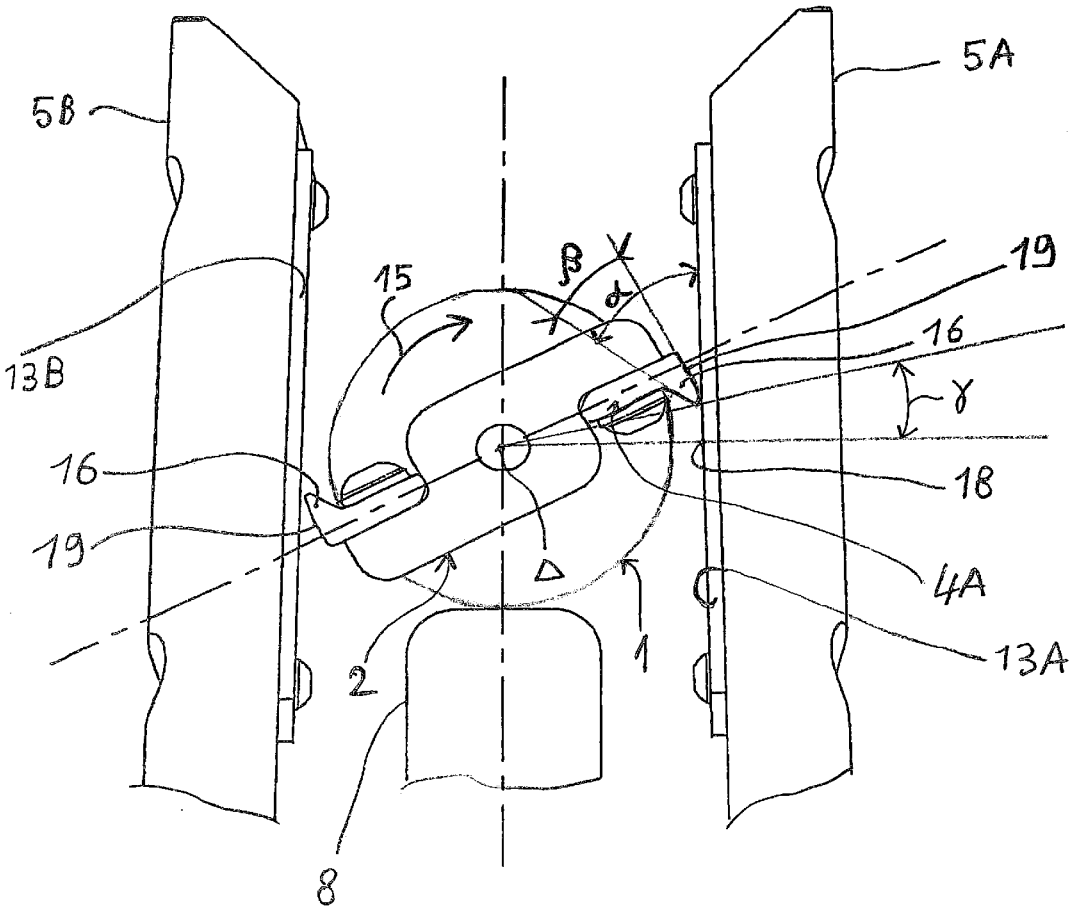
FIG. 7 is a diagram showing the angle of attack at which the hammer comes into contact with the jaw while the hammer is turning during closure of the disconnector.

During closure, the arm 1 starts by pivoting about its horizontal axis until it penetrates into the jaw, between the fingers 5A and 5B, by pivoting through an angle of about 92°, and the arm 1 then turns about its axis Δ through 90° in the direction indicated by the arrow 15 (FIG. 7). The disconnector is then in the closed position, as shown in FIGS. 1 to 3.

As is known, because of the current that flows through the arm 1 and the fingers 5A and 5B, as shown by the arrows (not referenced) in FIG. 1 (in the opposite direction during the next cycle), the arm 1 is subjected to a force F tending to urge the arm out of the jaw. This electrodynamic force becomes very large when a short-circuit occurs between a live phase and ground, or between two live phases.

In order to reduce this electrodynamic force, the fingers 5A and 5B are fixed to the jaw support 6 so that the angle E between the axis Δ of the arm 1 in the closed position and the fingers 5A–5B is greater than 90°.

The force F is at its maximum when the fingers 5A–5B are perpendicular to the axis Δ of the arm 1, and it decreases when said angle increases. By way of example, if angle E is 120°, the force F is about 0.6 times the force when angle E is 90°.

In addition, since the current flows through the fingers 5A and 5B in the same direction, they tend to be attracted. Thus, when a short-circuit occurs, the attraction force is large, and the force F results in a force tending to tear the fingers away from the jaw support.

Thus, by reducing the force F by means of the angle E being greater than 90°, it is possible to reduce the dimensioning of the jaw support and of the fixing of the fingers to the support, thereby lightening the weight of the assembly.

In the example shown, the angle E is about 120° C., and preferably lies in the range 100° to 140°.

As shown in FIG. 2, the fingers 5A and 5B are not parallel, but rather they form between them a small angle ϕ of a few degrees, approximately in the range 2° to 6°. For example, the fingers 5A and 5B are welded to the jaw support 6 so that they form an angle D of 88°, which gives an angle of 4° between the fingers 5A and 5B.

Thus, under short-circuit stress, the upward movement of the arm 1 is limited by this "tapering", which holds the hammer between the fingers and tends to increase the contact pressure during the movements of the disconnector under said electrodynamic stress.

For the purpose of further limiting the upward movement of the hammer between the fingers 5A and 5B when short-circuit stress occurs, a locking abutment 11 is fixed to a contact finger 5B at a level situated above the hammer 2 when the disconnector is in the closed position.

The abutment 11 does not constitute a hindrance to opening the disconnector because the opening operation starts with the hammer 2 turning through 90° in the direction of the arrow referenced 12 (FIG. 2) before the arm 1 pivots about a horizontal axis perpendicular to the plane of FIG. 1.

As mentioned above, the facing fingers 5A and 5B are fixed to the jaw support 6 by welding 7, with the angles E and D, and each of the fingers has a tubular profile that is open at both ends so as to induce heat exchange by convection in the tube. The fingers are made of aluminum, and each of them has its face that faces the facing row equipped with a copper contact blade 13A, 13B co-operating directly with the copper contact tabs 4A, 4B on the hammer 2.

This configuration of aluminum tubular fingers merely equipped with copper contact blades makes it possible to reduce considerably the weight of the contact fingers compared with the curved copper blades descried in the prior document mentioned in the introduction, while offering improved thermal performance and sufficient finger rigidity without requiring any additional spring, as is generally necessary in the prior art in which a spring is disposed between the jaw support and the curvature of the curved copper blade so as to impart sufficient rigidity to it.

A retaining rod, respectively 14A, 14B, and 14C, interconnects each pair of fingers 5A and 5B so as to limit the spacing between them. These retaining rods are situated approximately half-way along the length of the contact fingers 5A, 5B.

When the arm 1 turns in the direction indicated by arrow 15 (FIG. 7), at the end of disconnector closure, the fingers 5A, 5B bend, thereby forming springs, between the rods 14A, 14B, and 14C and the top end of the fingers, thereby guaranteeing that each finger is automatically positioned against the copper contact tabs 4A and 4*b* of the hammer 2, thus optimizing the line of contact between the hammer and the fingers.

It can be observed that, in the event of short-circuiting between phases, the arm 1 is subjected to an electrodynamic force moving it sideways in the direction $F_1$ or $F_2$ (FIG. 2) depending on whether the short-circuit takes place with a phase situated on the right or on the left of the phase on which the presently-described disconnector is situated. By means of the spring effect of the fingers and by means of the retaining rods 14A, 14B, and 14C, this sideways movement does not give rise to any breaking of the contact between the contact parts 4A and 4B of the hammer and the contact blades 13A, 13B of the fingers.

Figure 5:
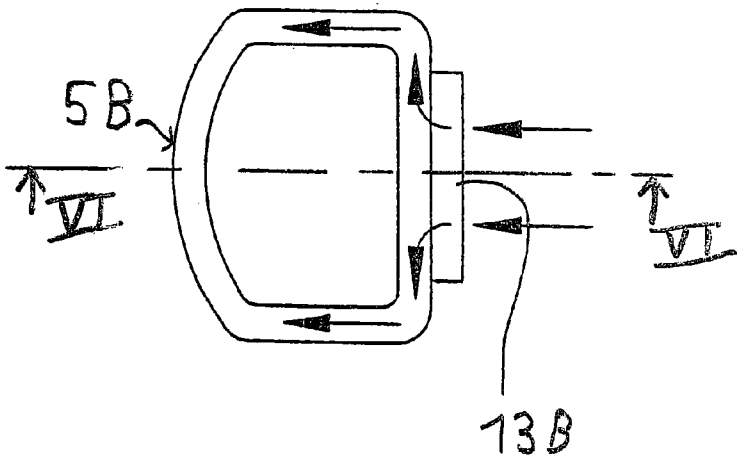
FIG. 5 shows the cross-section of a contact finger of the jaw.
Figure 6:
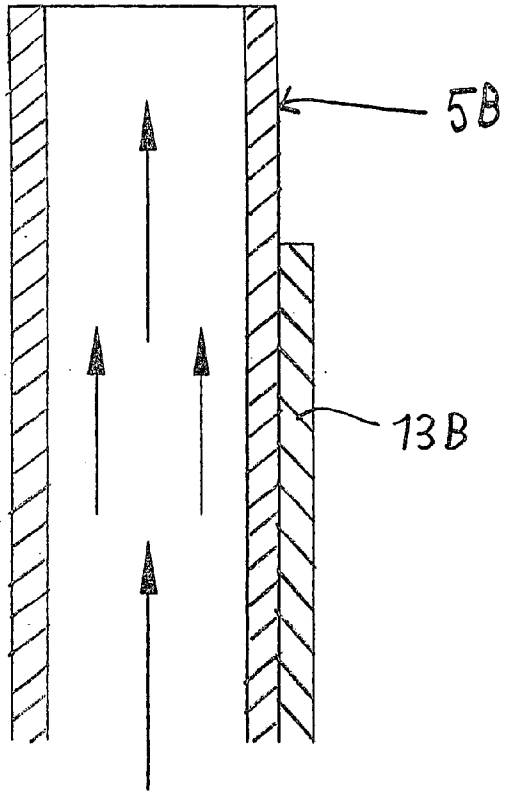
FIG. 6 is a section on VI—VI of FIG. 5.

FIG. 5 shows the cross-section of a finger, e.g. 5B, and FIG. 6 shows the same finger in section on VI—VI of FIG. 5.

FIG. 7 shows the position of the hammer 2 when, during closure, once the arm 1 has been lowered and has started turning about its own axis Δ, the ends of the copper contact tabs 4A and 4B of the hammer come into contact with the copper contact blades 13A and 13B of the contact fingers 5A, 5B.

As shown in FIG. 7, each of the tabs has a wedge-forming end 16 of angle β, and, on coming into contact, said tabs meet the fingers at an angle of attack α. This angle of attack α is less than 90° and is preferably about 60°, and it makes it possible to break any ice that has formed on the contact blades 13A, 13B. For example, the angle β of the wedge 16 is approximately in the range 30° to 40°.

Figure 8:
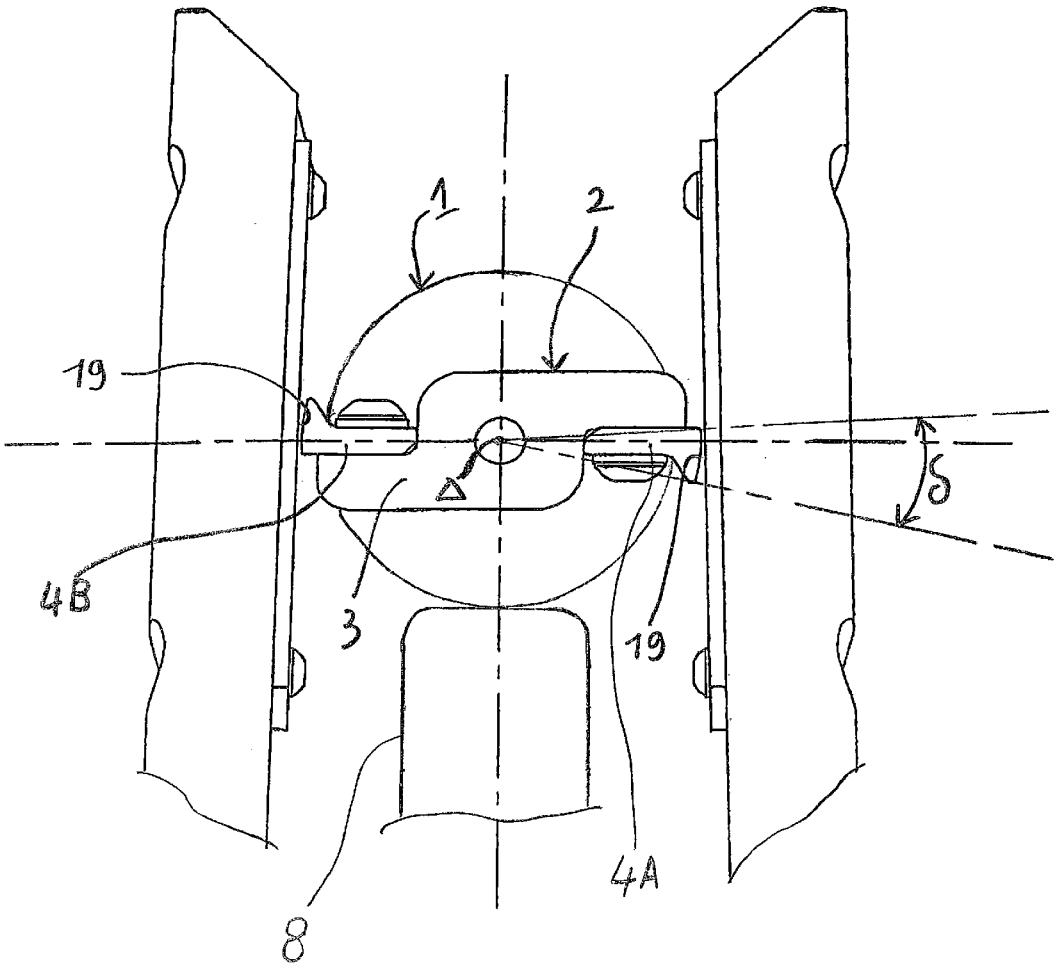
FIG. 8 is a diagram showing the angular range of constant-pressure contact over which the fingers of the jaw are in contact with the hammer with a constant pressure.

In addition, this contact takes place when the distance between the axis Δ and the tip of the wedge 16 is greater than the distance between the axis Δ and the fingers 13A, 13B so that, from that time until the tip of the wedge 16 arrives at the point 18, which corresponds to the arm having turned through an angle γ of about 10°, the contact tabs 4A, 4B push back the fingers 5A, 5B by acting like springs, the contact pressure increasing to that point. Then, since the contact face 19 is curved, the contact pressure remains substantially constant while the arm is turning through an angle δ (FIG. 8) of about 17°, corresponding to the angle δ covered by the contact surface 19 of the contact tabs 4A, 4B seen from the axis Δ. This constant-pressure contact through an angle δ of about 17° makes it possible to overcome angular differences caused by poor fitting or by loss of precision generated by component wear.

What is claimed is:

1. An air-insulated high-voltage disconnector including a pivotally-mounted arm suitable for pivoting at one of its ends about a horizontal axis that is perpendicular to the axis Δ of the arm, and also suitable for turning about its own axis Δ, the free end of the arm carrying a contact part or "hammer" which, when the disconnector is in the closed position, co-operates with a jaw comprising a jaw support to which two facing rows of contact fingers are fixed, wherein the hammer is equipped with contact tabs co-operating with the contact fingers, each contact tab forming a wedge of angle β, which wedge acts, during disconnector closure, to meet the corresponding row of fingers with an angle of attack α, said angle of attack α being less than 90°.

2. A disconnector according to claim 1, wherein the angle β is approximately in the range 30° to 40°.

3. A disconnector according to claim 1, wherein the angle α is about 60°.

4. A disconnector according to claim 1, wherein each contact tab is provided with a curved contact face extending over an angle δ, seen from the axis Δ of the arm, this angle δ being about 17°.

5. A disconnector according to claim 1, wherein, when the wedge of a contact tab comes into contact with one of said contact fingers, the angle γ, seen from the axis Δ of the arm, between the point of contact and the plane perpendicular to the contact finger containing the axis Δ, is about 10°.

6. A disconnector according to claim 1, wherein said contact fingers are fixed to the jaw support so that, when the disconnector is in the closed position, the angle E between the axis Δ of the arm and the contact fingers is greater than 90°.

7. A disconnector according to claim 1, wherein said facing fingers form an angle ϕ between them that lies in the range 2° to 6°.

8. A disconnector according to claim 1, wherein said contact fingers are tubular and open at both of their ends.

9. A disconnector according to claim 1, wherein a locking abutment is fixed to a contact finger at a level situated above said hammer when the disconnector is in the closed position.

* * * * *